US012240664B2

(12) United States Patent
Lozhko et al.

(10) Patent No.: US 12,240,664 B2
(45) **Date of Patent: *Mar. 4, 2025**

(54) PACKAGING FOR REEL-LESS BUNDLE OF CABLE

(71) Applicant: PPC BROADBAND, INC., East Syracuse, NY (US)

(72) Inventors: Andriy Lozhko, Syracuse, NY (US); Noah Montena, Syracuse, NY (US); Jay A. Kisselstein, Mexico, NY (US); Brian K. Hanson, Cicero, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/529,972

(22) Filed: Dec. 5, 2023

(65) Prior Publication Data

US 2024/0101301 A1 Mar. 28, 2024

Related U.S. Application Data

(63) Continuation of application No. 17/491,489, filed on Sep. 30, 2021, now Pat. No. 11,834,234.

(Continued)

(51) Int. Cl.
*B65D 85/66* (2006.01)
*B65D 5/02* (2006.01)

(Continued)

(52) U.S. Cl.
CPC ..... *B65D 5/0209* (2013.01); *B65D 5/0236* (2013.01); *B65D 81/02* (2013.01); *B65D 85/04* (2013.01)

(58) Field of Classification Search
CPC .... B65D 5/0209; B65D 5/0236; B65D 81/02; B65D 85/04

(Continued)

(56) References Cited

U.S. PATENT DOCUMENTS 1,772,850 A 8/1930 Wheldon
2,801,784 A 8/1957 Blatt (Continued)

FOREIGN PATENT DOCUMENTS

GB 537287 A 6/1941
GB 1187321 A 4/1970

OTHER PUBLICATIONS

Search Report dated Dec. 14, 2021 in corresponding International Application No. PCT/US2021/053043, 5 pages.

(Continued)

*Primary Examiner* — Luan K Bui
(74) *Attorney, Agent, or Firm* — MH2 TECHNOLOGY LAW GROUP LLP

(57) ABSTRACT

A packaging arrangement for a bundle of cable includes a planar packaging blank extending in a longitudinal direction from a first end to a second end. The blank includes a middle region extending from the first end to the second end between a first fold line and a second fold line, a first side extending from the first end to the second end and including a plurality of first flaps extending from the first fold line in a direction away from the second side in a direction perpendicular to the longitudinal direction, and a second side extending from the first end to the second end and including a plurality of second flaps extending from the second fold line in a direction away from the first side in a direction perpendicular to the longitudinal direction. The blank is configured to be rolled into a cylindrical shape such that the first end overlaps the second end. The plurality of first flaps are configured to be folded radially inward relative to the cylindrical blank, and the plurality of second flaps are configured to be folded radially inward relative to the cylindrical blank.

32 Claims, 2 Drawing Sheets

Related U.S. Application Data

(60) Provisional application No. 63/085,997, filed on Sep. 30, 2020.

(51) Int. Cl.
*B65D 81/02* (2006.01)
*B65D 85/04* (2006.01)

(58) Field of Classification Search
USPC ..... 206/389, 395–396, 398, 400, 407, 206/413–414, 442; 229/164, 242
See application file for complete search history.

(56) References Cited

U.S. PATENT DOCUMENTS

| | | | | |
|---|---|---|---|---|
| 2,883,045 | A | 4/1959 | Abramson | |
| 3,469,766 | A * | 9/1969 | Nelson | B65D 5/5445 229/164 |
| 3,823,866 | A * | 7/1974 | Elward | B65D 5/5445 229/235 |
| 3,837,597 | A | 9/1974 | Bourhenne | |
| 4,647,485 | A * | 3/1987 | Nelson | C09J 7/20 428/137 |
| 5,267,705 | A | 12/1993 | Hofrichter et al. | |
| 5,348,241 | A | 9/1994 | Huette | |
| 5,366,085 | A | 11/1994 | Kewin | |
| 5,551,647 | A | 9/1996 | Browning | |
| 5,873,464 | A | 2/1999 | Haley | |
| 6,814,232 | B1 | 11/2004 | Morris et al. | |
| 6,935,502 | B1 | 8/2005 | Stoll et al. | |
| 7,080,734 | B1 | 7/2006 | Morris et al. | |
| 8,056,717 | B2 | 11/2011 | Weissbrod | |
| 9,796,556 | B1 | 10/2017 | Hill et al. | |
| 2007/0295628 | A1 | 12/2007 | Uitenbroek | |
| 2010/0000895 | A1 | 1/2010 | Weissbrod | |
| 2014/0342114 | A1 * | 11/2014 | Beard | B65D 63/1009 427/208.4 |

OTHER PUBLICATIONS

Written Opinion dated Dec. 14, 2021 in corresponding International Application No. PCT/US2021/053043, 6 pages.

* cited by examiner

PACKAGING FOR REEL-LESS BUNDLE OF CABLE

CROSS-REFERENCE TO RELATED APPLICATION

This application is a continuation of U.S. patent application Ser. No. 17/491,489, filed Sep. 30, 2021, pending, which claims the benefit of U.S. Provisional Application No. 63/085,997, filed on Sep. 30, 2020. The disclosure of the prior application is hereby incorporated by reference herein in its entirety.

TECHNICAL FIELD

The present disclosure relates to packaging and, more particularly, to packaging for a reel-less bundle of cable, wire, and the like.

BACKGROUND

Many conventional types of packaging exist for cable, wire, and like (generally referred to as "cable"). For example, communication cable is often wound onto a reel or a spool, from which it can be easily paid out for use as needed. The reel-mounted cable is then packaged in a box for shipping and storage. Some conventional packaging boxes also include structures that permit payout of the cable while the cable remains in the box. With other conventional packaging boxes, the reel-mounted cable is removed from the box and mounted on a spindle for payout.

In other conventional packaging systems, cable is wound or rolled onto a temporary spool and removed from the spool before being packaged in a box or wrapped with shrink wrap for storage and shipping as a reel-less bundle of cable. Some box packaging permits reel-less bundles of cable to remain in the box while be paid out for use. The box packaging maintains the cable within the interior of the box. When all of the cable is paid out, the box can be recycled or otherwise disposed of, depending on the material of the box. Alternatively, the reel-less bundle of cable can be removed from the box and mounted on a reel for paying out. However, once removed from the box, the cable can become unraveled before the cable is mounted on the reel.

Similarly, for some shrink wrap packaging, the cable may be paid out from the center of the bundle while the shrink wrap maintains the outer perimeter of the bundle. With other shrink wrap packaging, the shrink wrap is removed, and the reel-less bundle of cable is mounted on a reel for paying out. Again, once the shrink wrap is removed, the cable can become unraveled before the cable is mounted on the reel. Also, when shrink-wrapped packaging is stacked for shipping and storage, the associated stresses are transferred directly to the cable, which could cause deformation of the cable, which could affect performance. Additionally, the plastic shrink wrap packaging is difficult to remove and typically requires a sharp tool to remove.

Therefore, it may be desirable to provide packaging for a reel-less bundle of cable that can be mounted on a reel for payout. It may be desirable to provide packaging for a reel-less bundle of cable that prevents the cable from unraveling until after the cable is mounted on the reel. It may also be desirable to provide packaging for a reel-less bundle of cable that can be removed from the bundle of cable without a tool. It may also be desirable to provide packaging for a reel-less bundle of cable that provides axial strength to the cable bundle during shipping and storage. It may also be desirable to provide packaging constructed of lighter material without sacrificing rigidity.

SUMMARY

According to an exemplary embodiment of the disclosure, a packaging arrangement for a bundle of cable includes packaging including a blank having a planar configuration and a cylindrical configuration, a first end panel, and a second end panel. In the planar configuration, the blank extends in a longitudinal direction from a first end to a second end. The planar configured blank includes a middle region extending from the first end to the second end in the longitudinal direction and extending between a first fold line and a second fold line in a direction perpendicular to the longitudinal direction, a tab extending from the first end in a direction away from the second end in the longitudinal direction, and a slit spaced from the first end. The planar configured blank also includes a first side extending from the first end to the second end and including a plurality of first flaps extending from the first fold line in a direction away from the second side in a direction perpendicular to the longitudinal direction, and a second side extending from the first end to the second end and including a plurality of second flaps extending from the second fold line in a direction away from the first side in a direction perpendicular to the longitudinal direction. In the cylindrical configuration, the blank is rolled such that the first end overlaps the second end, the slit is sized and configured to receive the tab when the blank is in the cylindrical configuration, the plurality of first flaps are folded toward one another such that the plurality of first flaps extend radially inward relative to the cylindrical configuration of the blank, and the plurality of second flaps are folded toward one another such that the plurality of second flaps extend radially inward relative to the cylindrical configuration of the blank. When the blank is in the cylindrical configuration and the plurality of first flaps and the plurality of second flaps are folded, the first end panel is attached to the plurality of first flaps to maintain the plurality of first flaps folded, and the second end panel is attached to the plurality of second flaps to maintain the plurality of second flaps folded.

In some aspects, the blank is configured to provide axial crush resistance to the packaging arrangement in the cylindrical configuration.

In various aspects, the blank is configured to receive a bundle of cable and provide axial crush resistance to the bundle of cable in the cylindrical configuration.

According to an exemplary embodiment of the disclosure, a packaging arrangement for a bundle of cable includes a packaging blank. In a first configuration, the blank extends in a longitudinal direction from a first end to a second end. The blank includes a middle region extending from the first end to the second end between a first fold line and a second fold line, a first side extending from the first end to the second end and including a plurality of first flaps extending from the first fold line in a direction away from the second side in a direction perpendicular to the longitudinal direction, and a second side extending from the first end to the second end and including a plurality of second flaps extending from the second fold line in a direction away from the first side in a direction perpendicular to the longitudinal direction. In a second configuration, the blank is rolled into a cylindrical shape such that the first end overlaps the second end, the plurality of first flaps are folded radially inward relative to the cylindrical blank, and the plurality of second flaps are folded radially inward relative to the cylindrical blank, A first end panel is configured to be attached to the folded plurality of first flaps and a second end panel is configured to be attached to the folded plurality of second flaps when the blank is in the second configuration.

In some aspects, the blank is configured to provide axial crush resistance to the packaging arrangement in the second configuration.

According to various aspects, the blank is configured to receive a bundle of cable and provide crush resistance to the bundle of cable in the second configuration.

In various aspects, the blank is made from paper or fiberboard.

According to some aspects, the plurality of first flaps are delineated by a first plurality of V-shaped notches, and the plurality of second flaps are delineated by a second plurality of V-shaped notches.

In some aspects, the middle region of the blank includes a first perforation line and a second perforation line, and the first and second perforation lines are configured to extend from the first end to the second end. According to various aspects, the first perforation line is spaced from the first fold line in a direction toward the second fold line, and the second perforation line is spaced from the second fold line in a direction toward the first fold line. According to some aspects, the first perforation line is coextensive with the first fold line, and the second perforation line is coextensive with the second fold line. In various aspects, the first end panel and the second end panel each comprise an adhesive backed paper or a sticker.

According to an exemplary embodiment of the disclosure, a packaging arrangement for a bundle of cable includes a planar packaging blank extending in a longitudinal direction from a first end to a second end. The blank includes a middle region extending from the first end to the second end between a first fold line and a second fold line, a first side extending from the first end to the second end and including a plurality of first flaps extending from the first fold line in a direction away from the second side in a direction perpendicular to the longitudinal direction, and a second side extending from the first end to the second end and including a plurality of second flaps extending from the second fold line in a direction away from the first side in a direction perpendicular to the longitudinal direction. The blank is configured to be rolled into a cylindrical shape such that the first end overlaps the second end. The plurality of first flaps are configured to be folded radially inward relative to the cylindrical blank, and the plurality of second flaps are configured to be folded radially inward relative to the cylindrical blank.

In some aspects, the packaging arrangement further comprises a first end panel configured to be attached to the plurality of first flaps when folded and a second end panel configured to be attached to the plurality of second flaps when folded.

According to various aspects, the blank is configured to provide axial crush resistance to the packaging arrangement when rolled into the cylindrical shape.

In various aspects, the blank is configured to receive a bundle of cable and provide crush resistance to the bundle of cable when rolled into the cylindrical shape.

According to some aspects, the blank is made from paper or fiberboard.

In some aspects, the plurality of first flaps are delineated by a first plurality of V-shaped notches, and the plurality of second flaps are delineated by a second plurality of V-shaped notches.

According to various aspects, the middle region of the blank includes a first perforation line and a second perforation line, and the first and second perforation lines are configured to extend from the first end to the second end. In various aspects, the first perforation line is spaced from the first fold line in a direction toward the second fold line, and the second perforation line is spaced from the second fold line in a direction toward the first fold line. In some aspects, the first perforation line is coextensive with the first fold line, and the second perforation line is coextensive with the second fold line.

According to some aspects, the first end panel and the second end panel each comprise an adhesive backed paper or a sticker.

In various aspects, the blank includes a tab extending from the first end in a direction away from the second end in the longitudinal direction and a slit spaced from the first end, and the slit is sized and configured to receive the tab when the blank is rolled into the cylindrical shape.

The foregoing and other features of construction and operation of the invention will be more readily understood and fully appreciated from the following detailed disclosure, taken in conjunction with accompanying drawings.

DETAILED DESCRIPTION OF EMBODIMENTS

As a preface to the detailed description, it should be noted that, as used in this specification and the appended claims, the singular forms "a," "an," and "the" include plural referents, unless the context clearly dictates otherwise.

Figure 3:
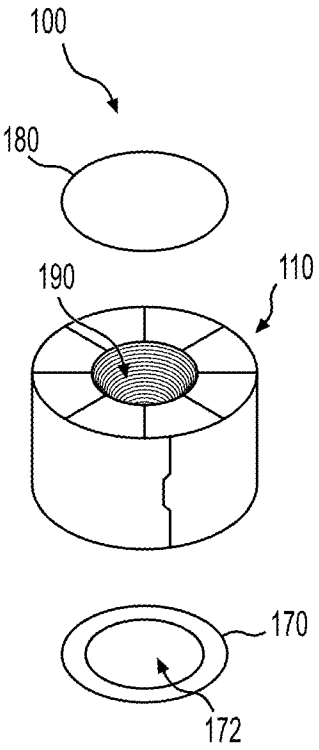
FIG. 3 is a partially exploded perspective view of the packaging arrangement of FIG. 2.
Figure 2:
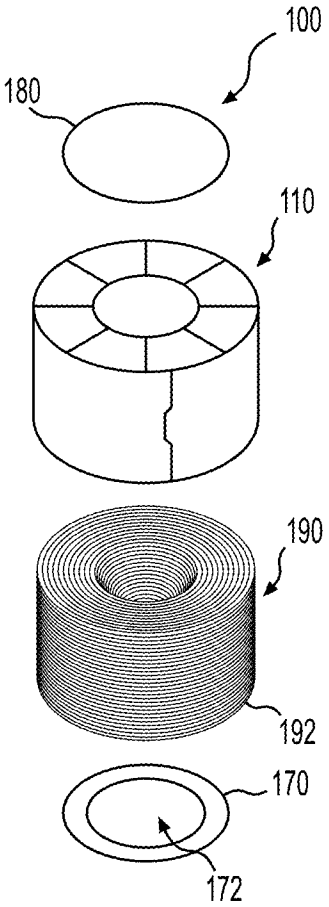
FIG. 2 is an exploded perspective view of a packaging arrangement for a reel-less bundle of cable.

An exemplary packaging arrangement 100 in accordance with various aspects of the disclosure is shown in FIGS. 2 and 3. The packaging arrangement 100 includes packaging 110, a first retaining member 170, and a second retaining member 180. The first and second retaining members 170, 180 may be an adhesive-backed paper or a sticker. In the exemplary embodiment shown in FIGS. 2 and 3, the first retaining member 170 is ring-shaped having an opening 172, and the second retaining member 180 is circular. However, it should be appreciated that either of the first and second retaining members 170, 180 may be ring-shaped or circular.

The packaging arrangement 100 is configured to package a bundle of cable, for example, a pre-rolled, reel-less bundle 190 of cable 192. The cable 192 may be any communications cable, such as coaxial cable, fiber optic cable, etc., or wire, or the like.

Figure 1:
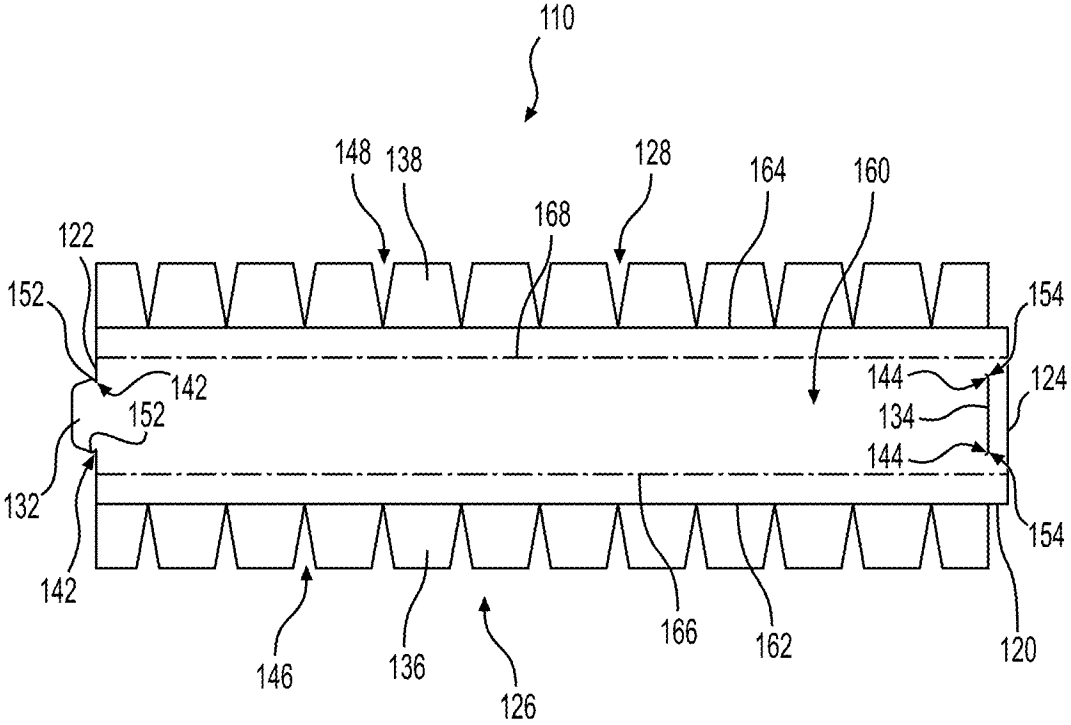
FIG. 1 is a top plan view of a blank for packaging a reel-less bundle of cable.

Referring to FIG. 1, a top plan view of an exemplary blank 120 for the packaging 110 is illustrated. The blank 120 can be made from paper or fiberboard (e.g., cardboard) that is recyclable to provide eco-friendly packaging. The blank 120 extends in a longitudinal direction from a first end 122 to a second end 124. The blank 120 includes a middle region 160 extending from the first end 122 to the second end 124 in the longitudinal direction and extending between a first fold line 162 and a second fold line 164 in a direction perpendicular to the longitudinal direction.

A tab 132 extends from the first end 122 in a direction away from the second end 124 in the longitudinal direction. The blank 120 includes a slit 134 proximate to but spaced from the first end 122. The slit 134 is sized and configured to receive the tab 132 when the blank 120 is formed into a cylinder with the first end 122 overlapping the second end 124, as shown in FIGS. 2 and 3. The tab 132 may include notches 142 adjacent, for example, immediately adjacent, to the first end 122, and the slit 134 may include curved end portions 144 at its opposite ends. As would be understood by persons skilled in the art, when the tab 132 is inserted into the slit 134 after the blank 120 is formed into a cylinder, the notches 142 are configured to cooperate with the curved end portions 144 to prevent the tab 132 from slipping out of the slit 134. For example, the widest sides 152 of the tab 132, which are adjacent to the notches 142 tuck behind the regions 154 of the blank 120 adjacent the slit 134.

As shown in FIGS. 2 and 3, the blank 120 includes a first side 126 and a second side 128. The first side 126 and the second side 128 extend from the first end 122 to the second end 124. The first side 126 includes a plurality of first flaps 136 that are delineated by a plurality of V-shaped notches 146. The first flaps 136 extend from the first fold line 162 in a direction away from the second side 128 in a direction perpendicular to the longitudinal direction. The second side 128 includes a plurality of second flaps 138 that are delineated by a plurality of V-shaped notches 148. The second flaps 138 extend from the second fold line 164 in a direction away from the first side 126 in a direction perpendicular to the longitudinal direction.

The middle region 160 of the blank 120 includes first and second perforation lines 166, 168 that extend from the first end 122 to the second end 124. The first perforation line 166 is spaced from the first fold line 162 in a direction toward the second fold line 164, and the second perforation line 168 is spaced from the second fold line 164 in a direction toward the first fold line 162. The distance between the first perforation line 166 and the first fold line 162 and the distance between the second perforation line 168 and the second fold line 164 may be any desired distance. The first and second fold lines 162, 164 may be generally parallel to one another and to the first and second perforation lines 166, 168. In some embodiments, the first perforation line 166 may be coextensive with the first fold line 162 and/or the second perforation line 168 may be coextensive with the second fold line 164.

In a first configuration, the blank 120 is laid flat, as shown in the top plan view of FIG. 1. In a second configuration, which is the packaging 110, the blank 120 is formed into a cylinder with the first end 122 overlapping the second end 124, as shown in FIGS. 2 and 3. In the second configuration, the tab 132 is inserted into the slit 134 so that the blank 120 can maintain a cylindrical shape. In the second configuration, the first flaps 136 are folded toward one another such that the first flaps 136 extend radially inward relative to the cylindrical shape of the blank 120. Similarly, the second flaps 138 are folded toward one another such that the second flaps 138 extend radially inward relative to the cylindrical shape of the blank 120.

In use, the blank 120 is provided in the first configuration as described above. The blank 120 is formed into a cylinder with the first end 122 overlapping the second end 124. In some aspects, the blank 120 is formed around a bundle 190 of cable 192, the first flaps 136 are folded toward one another, and the second flaps 138 are folded toward one another to provide the packaging 110 for the bundle 190. In other aspects, the blank 120 can be formed into a cylinder and either the first flaps 136 or the second flaps 136 can be folded toward one another before the packaging 110 is placed around the bundle 190. The first retaining member 170 is adhered to the first flaps 126 to maintain the first flaps 126 in their folded configuration. Similarly, the second retaining member 180 is adhered to the second flaps 128 to maintain the second flaps 128 in their folded configuration. The second configuration of the packaging 110 provides axial strength to the cable bundle 190 such that when the packaged cable bundles are stacked for shipping and storage, the associated stresses are transferred to the packaging 110 rather than the cable, which avoids undesirable deformation of the cable.

Figure 4:
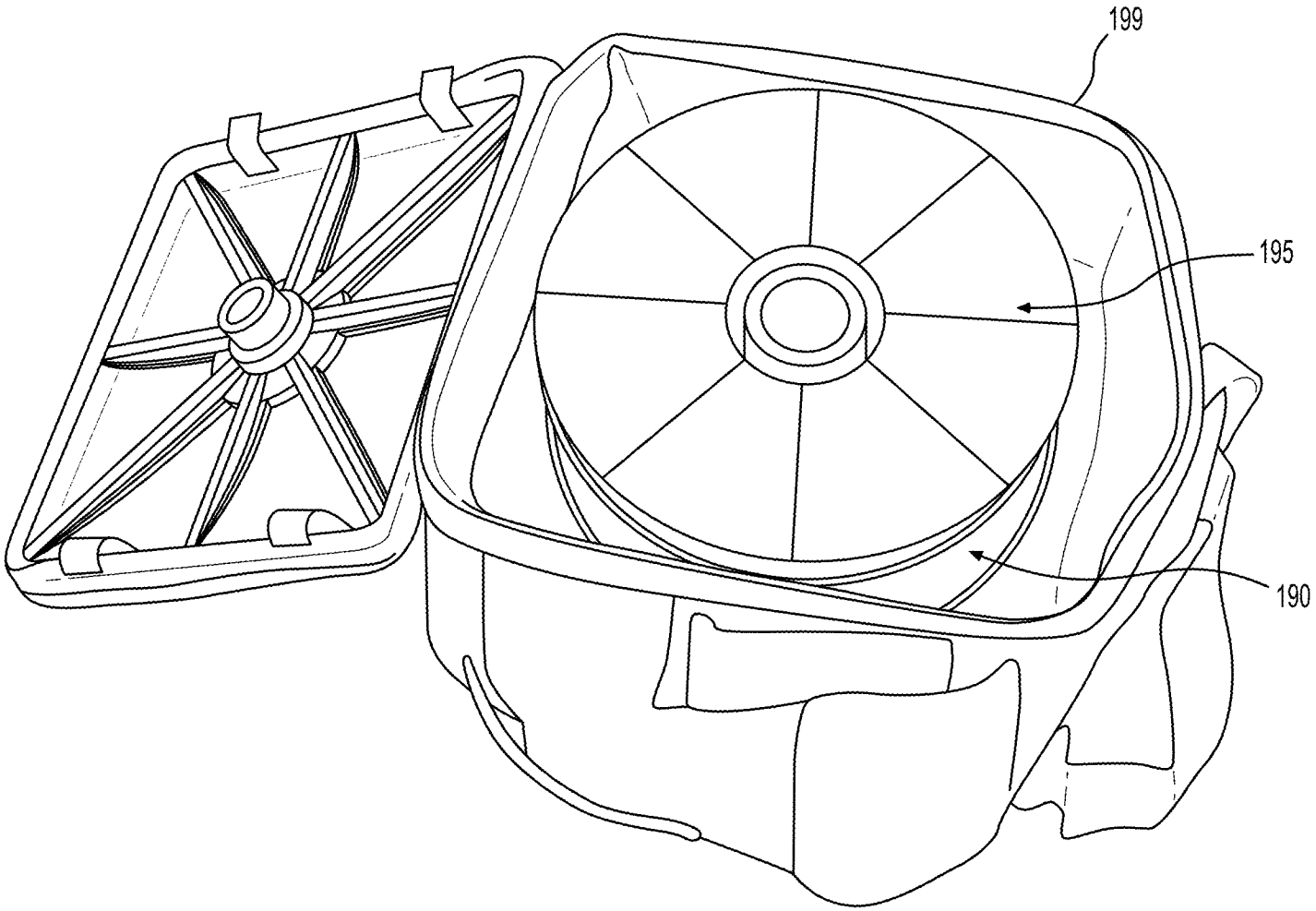
FIG. 4 is a perspective view of the packaging arrangement of FIG. 2 in a carrying bag.

When it is desired to use the reel-less bundle 190 of cable 192, a technician can mount the bundle 190 on a reel 195, as shown in FIG. 4. In an exemplary embodiment, the reel 195 can be a two-part reel having a removable flange portion that permits the reel-less bundle 190 to be mounted on a barrel portion of the reel 195. For example, when the removable flange portion is removed from the barrel portion, the barrel portion can be placed through the opening 172 of the first retaining member 170, through the first side 126 of the packaging 110, and through the reel-less bundle 190. The technician can then remove the tab 132 from the slit 134 and, by grasping the first end 122, the technician can remove part of the middle portion 160 by tearing along the first and second perforation lines 166, 168 all the way to the second end 124 to create an opening about the circumference of the packaging 110. The second side 128 of the packaging 110, including the second retaining member 180 can be removed, and the removable flange portion can be reattached to the barrel portion. Although the first side 126 remains between a second reel flange and the bundle 190 of cable 192, the first side 126 has only a slightly larger circumference than the bundle 190 and thus does not interfere with payout. Of course, the first side 126 can be removed if desired.

In some embodiments, the second side 128 of the packaging 110 can be left in place on the bundle 190, and the barrel portion and removable flange portion can be configured such that either the barrel portion or the removable flange portion can be punched through the second retaining member 180 for reconnection of the removable flange portion with the barrel portion. It should be appreciated that, in some embodiments, the second retaining member 180 can be ring-shaped such that the barrel portion or the removable flange portion can be passed through an opening of the second retaining member 180 and through the second side 128. It should also be appreciated that, in some embodiments, the second retaining member 180 can include a weakened section, for example, via perforations, that facilitates easy removal of the weakened section so that the barrel portion and the removable flange portion can be reconnected.

As shown in FIG. 4, after the bundle 190 of cable 192 is mounted on the reel 195, the reel 195 and bundle 190 can be placed inside of a carrying bag 199. The carrying bag 199 may include openings for passing cable 192 for paying out, as well as other conventional features that would be readily understood by persons skilled in the art. In some exemplary embodiments, the carrying bag 199 may include a frame to facilitate paying out the cable 192, and the reel 195 may be coupled with the frame before or after being placed into the bag.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A packaging arrangement for a bundle of cable, comprising:

a packaging blank;

wherein, in a first configuration, the blank extends in a longitudinal direction from a first end to a second end;

wherein the blank includes a middle portion extending from the first end to the second end between a first fold line and a second fold line;

a first flap portion extending from the first end to the second end and extending from the first fold line in a direction away from the middle portion in a direction perpendicular to the longitudinal direction; and a second flap portion extending from the first end to the second end and extending from the second fold line in a direction away from the middle portion in a direction perpendicular to the longitudinal direction;

wherein, in a second configuration, the blank is rolled into a cylindrical shape such that the first end overlaps the second end, and the first and second flap portions are folded radially inward relative to the cylindrical blank so as to provide packaging for a reel-less bundle of cable that is structurally configured to prevent the bundle of cable from unraveling and to provide axial strength to the bundle of cable; and wherein the middle portion of the blank includes a first perforation line and a second perforation line, and the first and second perforation lines are structurally configured to extend from the first end to the second end so as to permit the packaging to be removed from the bundle of cable without a tool.

2. The packaging arrangement of claim 1, wherein the blank is structurally configured to provide axial crush resistance to the packaging in the second configuration.

3. The packaging arrangement of claim 1, wherein the blank is structurally configured to receive a bundle of cable and provide axial crush resistance to the bundle of cable in the second configuration.

4. The packaging arrangement of claim 1, wherein the blank comprises paper or fiberboard.

5. The packaging arrangement of claim 1, wherein the first flap portion comprises a plurality of first flaps and the second flap portion comprises a plurality of second flaps.

6. The packaging arrangement of claim 5, wherein the plurality of first flaps are delineated by a first plurality of V-shaped notches; and wherein the plurality of second flaps are delineated by a second plurality of V-shaped notches.

7. The packaging arrangement of claim 1, further comprising a first end panel structurally configured to be attached to the folded first flap portion and a second end panel structurally configured to be attached to the folded second flap portion when the blank is in the second configuration so as to prevent the bundle of cable from unraveling and to provide axial strength to the bundle of cable.

8. The packaging arrangement of claim 7, wherein the first end panel and the second end panel each comprise an adhesive backed paper or a sticker.

9. The packaging arrangement of claim 1, wherein the first perforation line is spaced from the first fold line in a direction toward the second fold line, and the second perforation line is spaced from the second fold line in a direction toward the first fold line.

10. The packaging arrangement of claim 1, wherein the first perforation line is coextensive with the first fold line, and the second perforation line is coextensive with the second fold line.

11. A packaging arrangement for a bundle of cable, comprising:

a planar packaging blank extending in a longitudinal direction from a first end to a second end, the blank including:

a middle portion extending from the first end to the second end;

a first side portion extending from the first end to the second end and extending away from the middle portion in a direction perpendicular to the longitudinal direction; and a second side portion extending from the first end to the second end and extending away from the middle portion in a direction perpendicular to the longitudinal direction;

wherein, the blank is structurally configured to be rolled such that the first end overlaps the second end;

wherein the first side portion and the second side portion are structurally configured to be folded inward relative to the rolled blank so as to provide packaging for a reel-less bundle of cable that prevents the bundle of cable from unraveling and provides axial strength to the bundle of cable; and wherein the middle portion of the blank includes a first weakened portion and a second weakened portion, and the first and second weakened portions are structurally configured to extend from the first end to the second end so as to permit the packaging to be removed from the bundle of cable without a tool.

12. The packaging arrangement of claim 11, further comprising:

a first end panel structurally configured to be attached to the first side portion when folded and a second end panel structurally configured to be attached to the second side portion when folded.

13. The packaging arrangement of claim 12, wherein the first end panel and the second end panel each comprise an adhesive backed paper or a sticker.

14. The packaging arrangement of claim 11, wherein the blank is structurally configured to provide axial crush resistance to the packaging when rolled.

15. The packaging arrangement of claim 11, wherein the blank is structurally configured to receive a bundle of cable and provide crush resistance to the bundle of cable when rolled.

16. The packaging arrangement of claim 11, wherein the blank comprises paper or fiberboard.

17. The packaging arrangement of claim 11, wherein the first side portion includes a plurality of first flaps that are delineated by a first plurality of notches; and wherein the second side portion includes a plurality of second flaps that are delineated by a second plurality of notches.

18. The packaging arrangement of claim 11, wherein the first weakened portion is spaced from the first side portion in a direction toward the second side portion, and the second weakened portion is spaced from the second side portion in a direction toward the first side portion.

19. The packaging arrangement of claim 11, wherein the first weakened portion is coextensive with a first fold between the first side portion and the middle portion, and the second weakened portion is coextensive with a second fold between the second side portion and the middle portion.

20. The packaging arrangement of claim 11, wherein the first weakened portion comprises a first perforated portion, and the second weakened portion comprises a second perforated portion.

21. A packaging arrangement for a bundle of cable, comprising:

a planar packaging blank extending in a longitudinal direction from a first end to a second end, the blank including:

a middle portion extending from the first end to the second end; and a retaining portion extending from the first end to the second end and extending away from the middle portion in a direction perpendicular to the longitudinal direction;

wherein, the blank is structurally configured to be rolled such that the first end overlaps the second end so as to provide packaging for a reel-less bundle of cable that is structurally configured to prevent the bundle of cable from unraveling; and wherein the middle portion of the blank includes a weakened portion, and the weakened portion is structurally configured to extend from the first end to the second end so as to permit the packaging to be removed from the bundle of cable without a tool.

22. The packaging arrangement of claim 21, wherein the blank is structurally configured to provide axial crush resistance to the packaging when rolled.

23. The packaging arrangement of claim 21, wherein the blank is structurally configured to receive a bundle of cable and provide crush resistance to the bundle of cable when rolled.

24. The packaging arrangement of claim 21, wherein the blank comprises paper or fiberboard.

25. The packaging arrangement of claim 21, wherein the retaining portion comprises a first retaining portion extending from a first side of the middle portion and a second retaining portion extending from a second side of the middle portion.

26. The packaging arrangement of claim 25, wherein the first retaining portion and the second retaining portion are structurally configured to be folded inward relative to the rolled blank so as to provide the packaging that prevents the bundle of cable from unravelling and to provide axial strength to the bundle of cable.

27. The packaging arrangement of claim 26, further comprising:

a first end panel structurally configured to be attached to the first retaining portion when folded and a second end panel structurally configured to be attached to the second retaining portion when folded.

28. The packaging arrangement of claim 27, wherein the first end panel and the second end panel each comprise an adhesive backed paper or a sticker.

29. The packaging arrangement of claim 25, wherein the first retaining portion comprises a plurality of first flaps delineated by a first plurality of V-shaped notches; and wherein the second retaining portion comprises a plurality of second flaps delineated by a second plurality of V-shaped notches.

30. The packaging arrangement of claim 25, wherein the weakened portion comprises a first weakened portion spaced from the first retaining portion in a direction toward the second retaining portion and a second weakened portion spaced from the second retaining portion in a direction toward the first retaining portion.

31. The packaging arrangement of claim 30, wherein the first weakened portion is coextensive with a first fold between the first retaining portion and the middle portion, and the second weakened portion is coextensive with a second fold between the second retaining portion and the middle portion.

32. The packaging arrangement of claim 30, wherein the first weakened portion comprises a first perforated portion, and the second weakened portion comprises a second perforated portion.

* * * * *